United States Patent [19]

Bassetto

[11] 4,198,108

[45] Apr. 15, 1980

[54] SOCKET FOR FLUORESCENT LAMP

[76] Inventor: Mario F. Bassetto, 1230 Presidente Wilson Ave., Sao Paulo, Brazil

[21] Appl. No.: 959,818

[22] Filed: Nov. 13, 1978

[30] Foreign Application Priority Data

Feb. 27, 1978 [BR] Brazil ..... 5800225[U]

[51] Int. Cl.[2] ..... H01R 33/08

[52] U.S. Cl. ..... 339/50 R; 339/93 L; 339/276 F; 362/260

[58] Field of Search ..... 339/50, 51, 52 R, 52 S, 339/53, 54, 55, 56, 57, 93, 276 F; 240/51.11

[56] References Cited

U.S. PATENT DOCUMENTS

| | | | |
|---|---|---|---|
| 2,468,481 | 4/1949 | Burt | 339/56 |
| 3,397,376 | 8/1968 | Gombar | 339/56 |

*Primary Examiner*—Roy Lake
*Assistant Examiner*—DeWalden W. Jones
*Attorney, Agent, or Firm*—Michael J. Striker

[57] ABSTRACT

An improved socket, particularly for a fluorescent lamp, includes a base, a casing which has guide passages for inserting therein the contact pins of the lamp, holes adjacent to the guide passages and communicating therewith. The holes receive power terminals, which are maintained in a desired position by a spring. The base and the casing are integrally connected to one another by a web which permits the casing to tilt relative to the base within a limited tilting range.

9 Claims, 4 Drawing Figures

CORTE B-B

CORTE A-A

SOCKET FOR FLUORESCENT LAMP

BACKGROUND OF THE INVENTION

The present invention relates to sockets. More particularly the present invention concerns sockets for fluorescent lamps.

A conventional socket includes a casing mountable on a base by means of bolts, fins, threads, etc.

Obviously, mounting the casing on the base is time-consuming.

Besides, when in assembly with the base, the casing is rigid. In other words, any tilting movement of the casing is excluded, thus making it complex to install such a socket on a wall and consequently a lamp in such a socket.

SUMMARY OF THE INVENTION

It is a general object of the present invention to avoid the disadvantages of the prior art sockets.

More particularly, it is an object of the present invention to provide a socket which would have a casing integrally connected to the base, thus facilitating manufacture of the sockets and reducing the cost of the same correspondingly.

Another object of the present invention is to provide a socket comprising a casing, a base and an elastomeric web integrally connecting the base and the casing to each other, which makes the installation of the socket and a lamp in such a socket considerably easier due to tilting movement of the casing relative to the base.

In pursuance of these objects and others which will become apparent hereafter, one feature of the present invention resides in providing a socket which includes a base, a casing which has guide passages for inserting therein the contact pins of the lamp, holes adjacent to the guide passages and communicating therewith. The holes receive power terminals. There are provided resilient means for maintaining the terminals in a desired position relative to the contact pins of the lamp inserted in the guide passages of the casing. The improvement of the socket comprises means integrally connecting said base to said casing so that said casing is tiltable relative to said base within a limited tilting range.

The novel features which are considered as characteristic for the invention are set forth in particular in the appended claims. The invention itself, however, both as to its construction and its method of operation, together with additional objects and advantages thereof will be best understood from the following description of specific embodiments when read in connection with the accompanying drawings.

DESCRIPTION OF PREFERRED EMBODIMENTS

Figure 1:
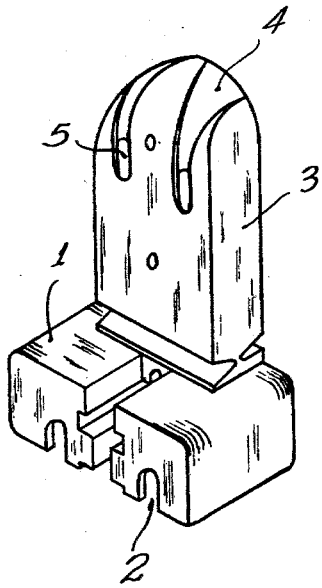
FIG. 1 is a perspective view of a socket in accordance with the present invention.

Referring now to the drawings and first to the FIG. 1 thereof, it may be seen that the reference 1 designates a base of electrically insulating material. The base 1 has the form of a parallelepiped and is provided with conventional holes 2 for wires. A casing 3 is also of electrically insulating material and is provided with guides 4 operative for inserting therein the contact pins of a lamp (not shown). The casing 3 is further provided with holes 5 adjacent to the guide passages and communicating therewith. The holes 5 are operative for receiving therein power terminals 6. A spring 7 is further provided in the casing 3 for maintaining the terminals 6 in a desired position relative to the contact pins of the lamp inserted in the guides 4 of the casing 3. The casing 3 is integrally connected to the base 1 by a web 9 of elastomeric material. The web 9 has a double V-shaped cross-section, which permits a limited tilting movement of the casing relative to the base.

Such a construction considerably facilitates installing or withdrawing of the fluorescent lamp in such a socket. A light pressure on the socket is enough to perform the operation of installing the lamp in the socket. In a normal position the socket will firmly and reliably maintain the fluorescent lamp, preventing any accidental fall of the latter.

Figure 2:
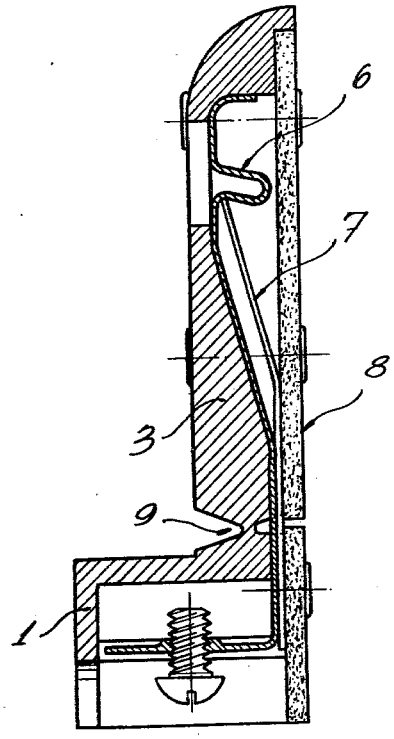
FIG. 2 is a vertical section through the socket shown in FIG. 1.
Figure 3:
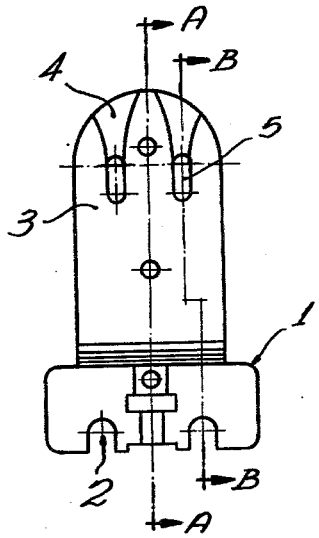
FIG. 3 is a front view of the socket.
Figure 4:
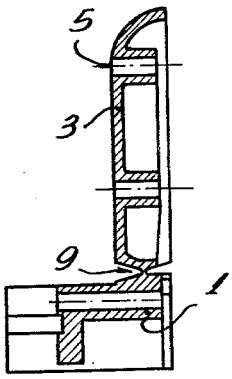
FIG. 4 is a cross-sectional view taken along the line A—A in FIG. 3.

Thus, the one-piece socket makes it considerably easier to install the socket on a wall and the lamp in such a socket. A plate of electrically insulating material is mounted on the casing 3 (see FIG. 2) for closing the latter.

It will be understood that each of the elements described above, or two or more together, may also find a useful application in other types of an improved socket differing from the types described above.

While the invention has been illustrated and described as embodied in an improved socket, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An improved socket, particularly for a fluorescent lamp, of the type including a base, a casing having guide passages for inserting therein the contact pins of the lamp, holes adjacent to the guide passages and communicating therewith, said holes being operative for receiving therein power terminals, and resilient means for maintaining the terminals in a desired position relative to the contact pins of the lamp inserted in the guide passages of the casing, wherein the improvement comprises means integrally connecting said base to said casing so that said casing is tiltable relative to said base within a limited tilting range.

2. A socket as defined in claim 1, wherein said connecting means constitute a web connecting said casing to said base.

3. A socket as defined in claim 2, wherein said web has a double V-shaped cross-section.

4. A socket as defined in claim 1, wherein said base has holes for receiving therein wires.

5. A socket as defined in claim 1, wherein said casing has a circumferentially incomplete wall provided with said guide passages and holes.

6. A socket as defined in claim 5, wherein said casing further provided with a plate mountable on said wall for circumferentially completing the same.

7. A socket as defined in claim 6, wherein said plate is of electrically insulating material.

8. A socket as defined in claim 1, wherein said resilient means comprise a spring urging said power terminals in the desired position.

9. A socket as defined in claim 2, wherein at least said web is of elastomeric material.

* * * * *